United States Patent [19]

Wiles et al.

[11] Patent Number: 4,519,518

[45] Date of Patent: May 28, 1985

[54] MEANS FOR MOUNTING A CLOSURE IN A PREDETERMINED POSITION

[75] Inventors: Laurence E. Wiles, Cheshire; Frank C. Page, III, Watertown, both of Conn.

[73] Assignee: Specialty Packaging Products, Inc., Bridgeport, Conn.

[21] Appl. No.: 615,937

[22] Filed: May 31, 1984

[51] Int. Cl.[3] ..... B65D 41/04

[52] U.S. Cl. ..... 215/331

[58] Field of Search ..... 215/331, 332; 220/288, 220/296, 304

[56] References Cited

U.S. PATENT DOCUMENTS 1,612,449 12/1926 Lee ..... 215/331

3,005,569 10/1961 Williamson ..... 220/304

4,387,821 6/1983 Geiger ..... 215/332 X

OTHER PUBLICATIONS

Auto-Seal Screw Top-Augros Publication.

*Primary Examiner*—Donald F. Norton

[57] ABSTRACT

A container with a threaded neck portion is adapted to be closed with a closure engaging the threads of the neck portion. The threads of the neck portion have at least two stops disposed at opposite ends of the threads. The threads may be continuous or interrupted but have a maximum pitch of 8 degrees. The two stops of the threads on the neck portion insure that the closure is stopped at a predetermined position relative to the container after full-threaded rotation of the closure onto the threaded neck portion has been carried out.

10 Claims, 17 Drawing Figures

FIG. 11
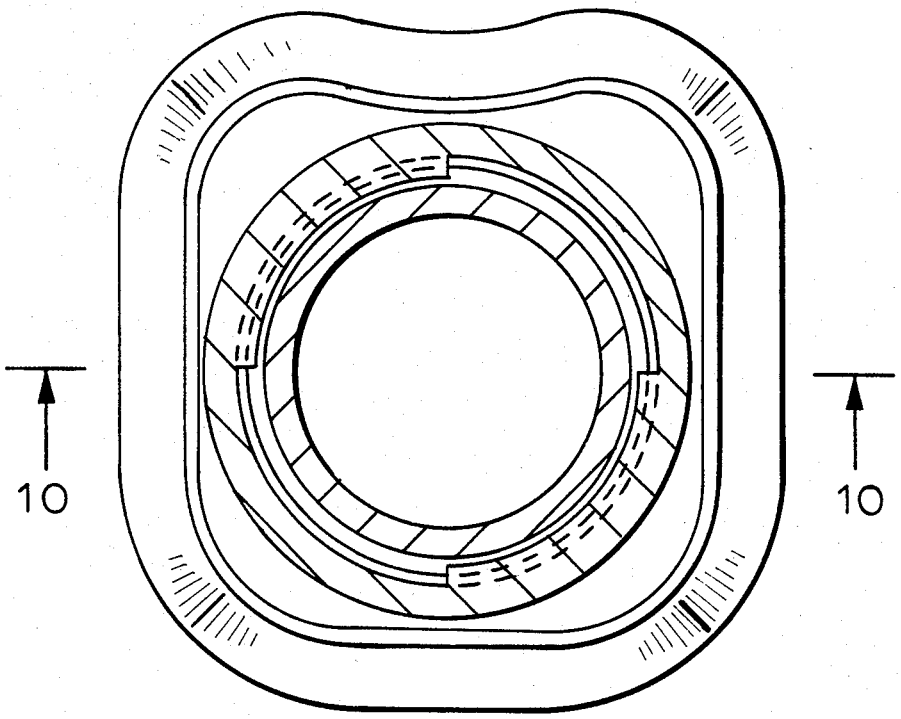
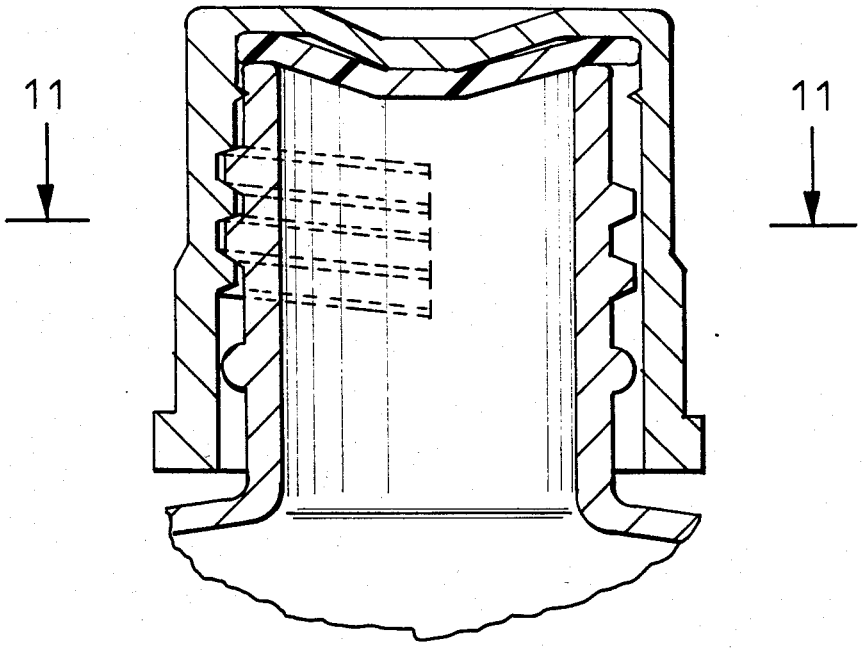
FIG. 10

FIG. 12
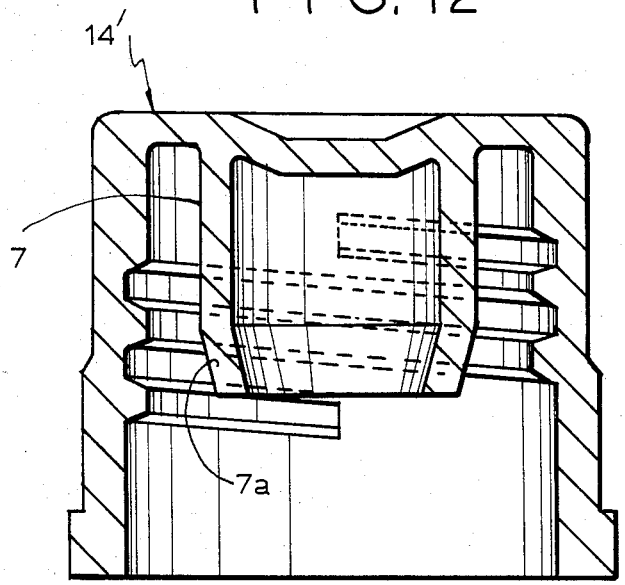
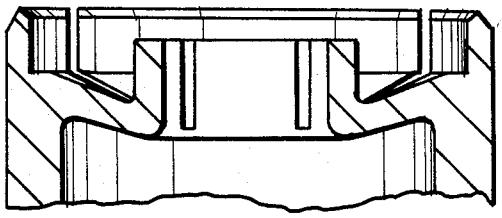
FIG. 15

MEANS FOR MOUNTING A CLOSURE IN A PREDETERMINED POSITION

BACKGROUND OF THE INVENTION

Many closures have been suggested in recent years because of intense development directed toward insuring that dangerous and poisonous materials be packaged in container without endangering unqualified persons who may open such containers, for example small children.

Closures have also been suggested for packaging innocuous material, in which the closure is mounted on the container in a predetermined position, preferable in the position wherein indicia on the closure is aligned with indicia on the container. Such a feature constitutes an important advantage in the plastic container state of the art for aesthetic reasons because such alignment makes for a much more attractive appearance of the closed container. Such a closure is, for example, disclosed and described in copending U.S. Pat. No. 4,387,817. However, such a closure is primarily designed to be child-resistant and only has as a secondary design feature the ability to have the closure aligned with the container. Moreover, the means for aligning the closure with the container in the afore-said state of the art includes a plurality of thread segments which are disposed on the neck of the closure each one of which must have an arrow-head portion. These arrow-head portions interlockingly engage in gaps formed on a mating thread in the closure. When such engagement between arrow head and gap occurs, the closure is mounted in its predetermined position on the neck of the container. This type of closure also requires a pressing down force before the closure can be unscrewed.

However, it has been found that such a means of mounting a closure on a container neck is not reliable for locking the closure on the container neck because such means are mechanically weak and a person threadably mounting the closure on the container frequently moves the closure past the stop formed by the arrow-head thereby "stripping" the threads of the closure.

SUMMARY OF THE INVENTION

It is a general object of this invention to provide means for positioning a closure on the neck of a container in predetermined position relative to the container.

It is a more specific object of this invention to provide at least two stops on the threads of the neck portion to assure that the closure, when being threadably mounted on the neck portion, cannot "strip" the threads thereof.

It is another specific object of this invention to insure a tight seal by a closure which is threadably mounted on the neck portion, and which is provided with means for predeterminedly positioning the closure on the neck portion and at the same time enabling the user to so position the closure when closing the container and also making it possible for the user to easily remove the closure when opening the container.

BRIEF DESCRIPTION OF THE DRAWING

These and other features contributing to satisfaction in use and economy and manufacture will be more fully understood from the following description of several preferred embodiments of the invention when taken in conjunction with the accompanying drawings, wherein identical numerals refer to identical parts and in which:

FIG. 10 is a cross-sectional view along plane 10—10 of FIG. 11 of a closure threadably mounted on the neck portion of a container forming a second embodiment (interrupted thread) of the invention;

FIG. 11 is a view along plane 11—11 of FIG. 10;

FIG. 12 is a cross-sectional view of a third embodiment (linerless closure) of the closure in accordance with the invention;

FIG. 15 is a cross-sectional view along plane 15—15 of FIG. 13;

DESCRIPTION OF THE PREFERRED EMBODIMENTS

Figure 1:
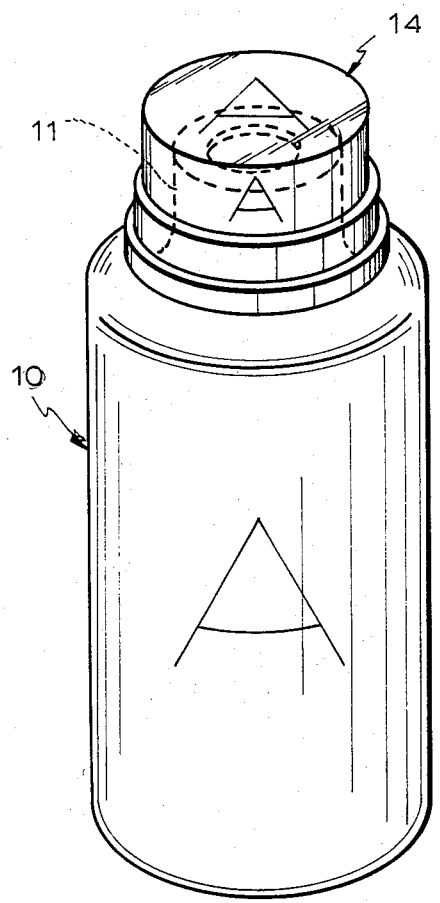
FIG. 1 illustrates schematically a cylindrical container and closure in accordance with the invention which are aligned in a predetermined manner.

Referring now to the drawings, there is illustrated in FIG. 1 a cylindrical container 10 having indicia "A" mounted on the side wall thereof which container 10 has a cylindrical neck portion 11 extending therefrom which neck portion has a thread in accordance with the invention. A cylindrical closure 14 having an internal threaded portion 15 is threadably mounted on the neck portion 11. The top closure 14 has indicia "A" on the cylindrical side wall and or top thereof. When the closure 14 is threadably mounted home on the neck portion 11 the indicia "A" of the closure 14 lines up with the indicia "A" on the container 10.

Figure 2:
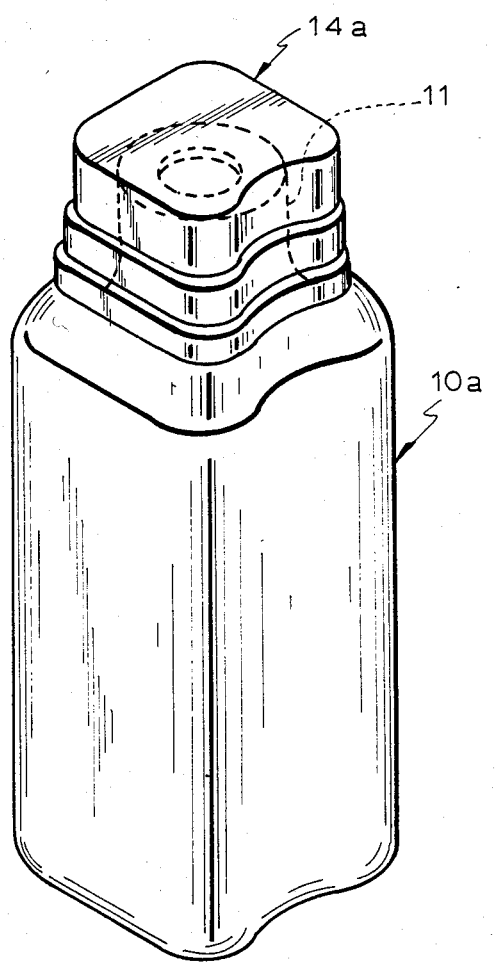
FIG. 2 is another non-cylindrical container and closure in accordance with this invention which are also aligned in a predetermined manner.

In FIG. 2 there is illustrated a container 10*a* which has a non-cylindrical shape and which has also a neck portion 11 in accordance with the invention. A non-cylindrical top closure 14*a* is threadably mounted home on the neck portion 11, whereby the top closure 14*a*, which is of similar shape to the container 10*a*, aligns with the same.

Figure 3:
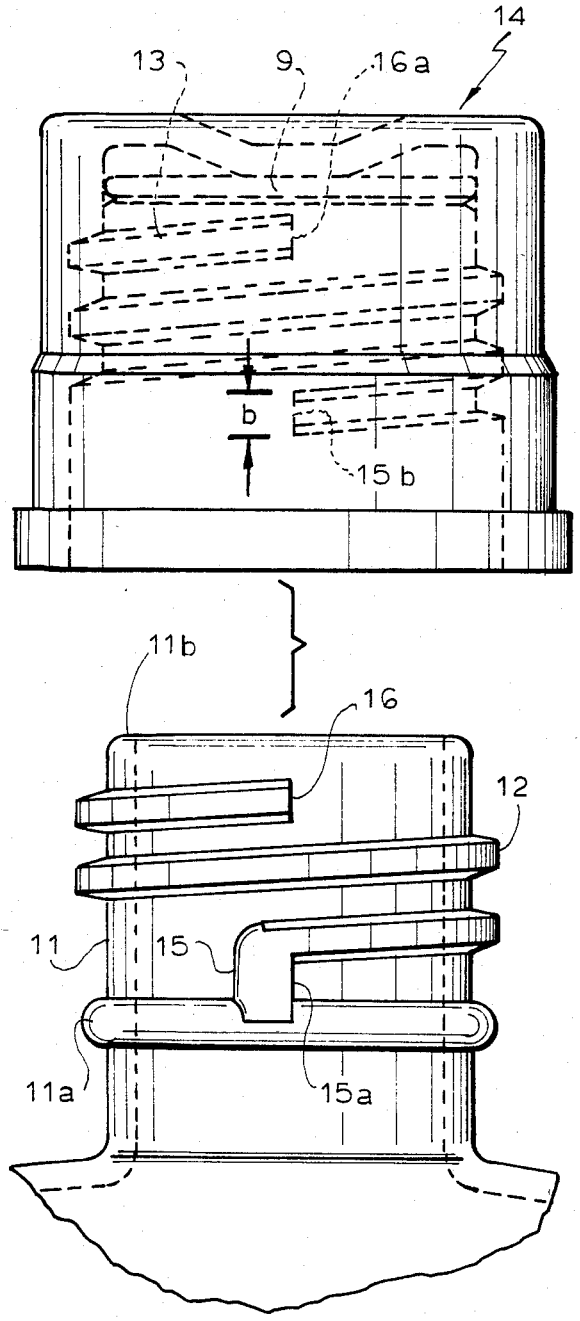
FIG. 3 is an exploded view of a neck portion of a first embodiment of the invention showing a container and a closure to be mounted thereon in accordance with the invention.

There is illustrated in FIG. 3, in exploded view, a neck portion 11 and a top 14 in accordance with the invention. The thread 12 includes a bottom stop portion 15 which extends parallel to the longitudinal axis of the container 10. This stop 15 has a stop surface 15*a* which is adapted to coact with a stop surface 15*b* of the mating thread 13 of the top closure 14. The thread 12 also has a top surface 16 which coacts with a corresponding stop surface 16*a* of the internal thread 13 of the top closure 14. While the stop surfaces 15*a* and 16 of the thread 12 and the stop surface 15*b* and 16*a* of the internal thread 13 are shown as being axially aligned, they may also be non-aligned. However, the axial alignment, in particular a 360° rotational spacing, makes for a better and tighter seal because it offers the most efficient torque resistance against an excessively large rotational force which may be applied. The neck portion 11 includes a transfer bead 11*a*, the axial distance "a" between the top of the transfer bead 11*a* and the bottom of the flank of the thread cross-section at its lowest point is slightly larger than the distance "b" which is the width of the thread cross-section of the threads 13 in the closure, so that when this mating thread 13 is turned home against the stop surface 15*a* a clamping action is effected by the transfer bead 11*a* and the lower end of the thread 12 which increases further the torque resistance.

Figure 4:
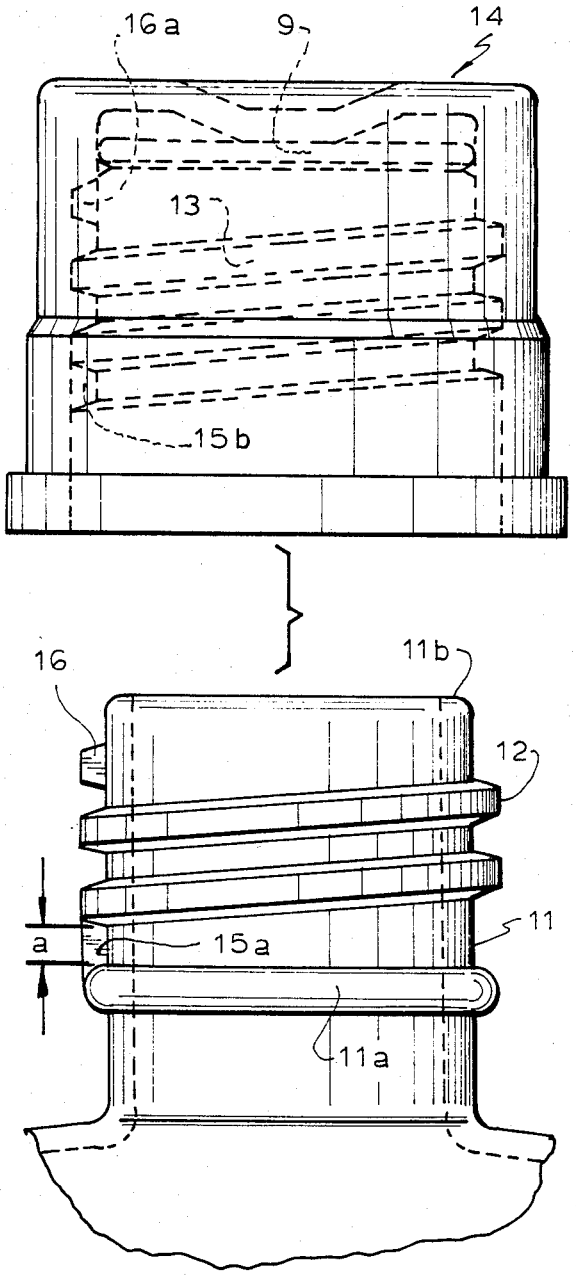
FIG. 4 is an exploded view similar to that of FIG. 3 but in which the closure and neck portion are rotated 90° from the position illustrated in FIG. 3.

As can be noted by those skilled in the art the threads 12 and 13 of the embodiment of FIGS. 3 and 4 is of the "acme" or "buttress" thread type. It has been found that those types of threads work best with the closures of this invention.

Moreover, as has been stated hereinabove, the pitch angle is less than 8°. By so limiting the pitch angle the optimum amount of friction is obtained for turning the closure home thereby obtaining a good seal while at the same time enabling the user to easily seal and unscrew the closure top.

The afore-described embodiment as well as all the other embodiments which will be described hereinafter are made, preferably, by injection molding techniques. While many types of plastic materials, suitable for mass-production by injection molding techniques, may be used as material for the closures of this invention, the most advantageous has been found to be polypropylene. By using the afore-described thread construction, pitch angle and material, a self-locking effect is achieved.

Figure 5:
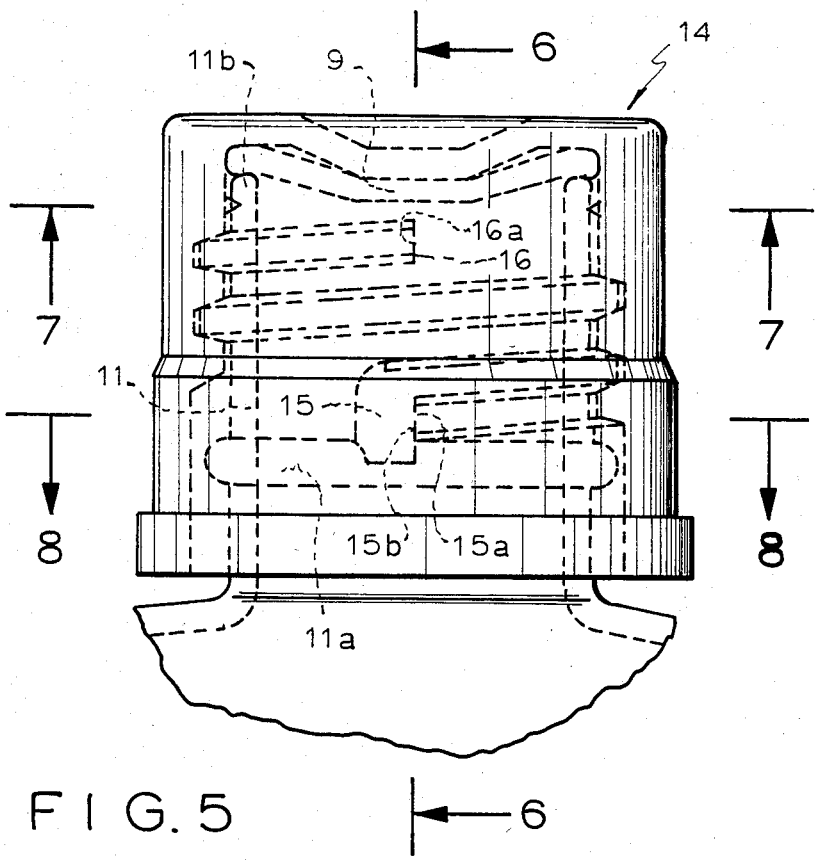
FIG. 5 is a side-elevational view of the first embodiment of a neck portion and closure in accordance with the invention in which the closure is shown as mounted on the neck portion.
Figure 6:
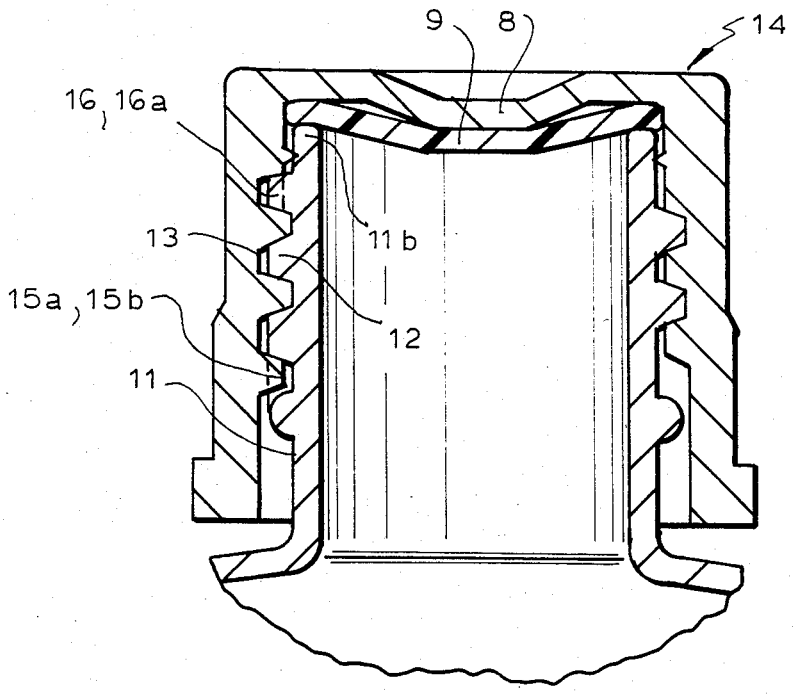
FIG. 6 is a cross-sectional view along plane 6—6 of FIG. 5.

FIGS. 5 and 6 illustrates a sealing disc 9 which is of flexible material and which is inserted into the top closure 14 prior to assembly (held in by retaining bead X (FIG. 9)). When screwing the top closure 14 fully home on the neck portion 11 this sealer is bent as shown in FIGS. 5 and 6 by an inwardly extending protrusion 8 in the top closure 14 to thereby obtain a good sealing action between the sealing disc 9 with the orifice of the neck portion 11.

Figure 7:
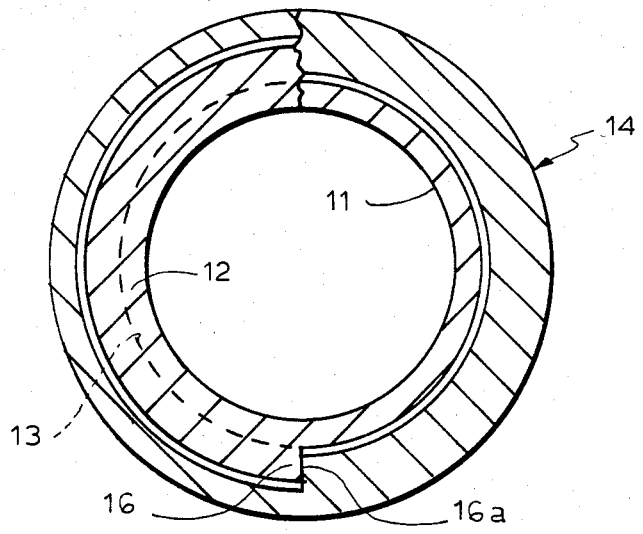
FIG. 7 is a schematic cross-sectional view along plane 7—7 of FIG. 5.
Figure 8:
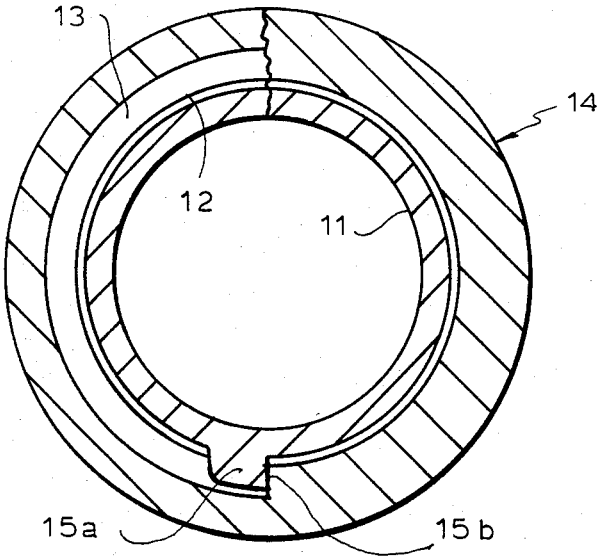
FIG. 8 is a schematic cross-sectional view along plane 8—8 of FIG. 5.

FIGS. 7 and 8 illustrate respectively the coaction between the stop surfaces 16, 16*a* and 15*a* and 15*b*.

Figure 9:
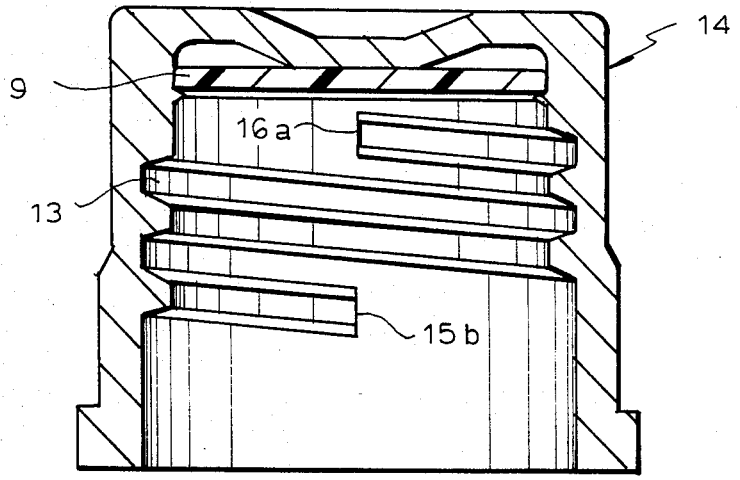
FIG. 9 is a cross-sectional view of the top closure of FIGS. 3 to 8 standing alone.

FIG. 9 illustrates the top closure 14 and sealing disc 9. FIGS. 10 and 11 illustrate an alternate version of the closure assembly of this invention. This closure assembly has an interrupted thread which permits the use of collapsible cores in injection molding techniques. While such a closure assembly has a less stable torque resistance, it still functions adequately. Obviously the greater the interruption in the thread the lower the torque resistance stability.

The embodiment of FIGS. 10 and 11 functions similarly to the embodiment of FIGS. 3 to 9. In this embodiment the threads of the closure and neck portion also have coacting top and bottom stop surfaces.

In FIG. 12 there is illustrated a modified version of a top closure which has an inwardly extending neck portion 7 that is flexible movable with respect to the top 14' of the top closure 14 and which is adapted to engage in a known manner the inner top edge of a non-illustrated neck portion. For this purpose the neck portion 7 is provided with an inwardly tapered frusto-conical portion 7*a* which engages the upper edge of the non-illustrated neck portion.

Figure 13:
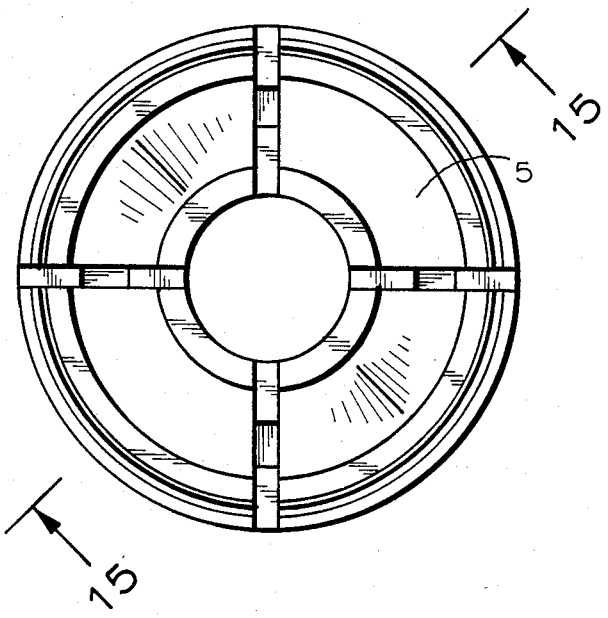
FIG. 13 is a plan view of a top closure, forming a fourth embodiment of the invention, in which embodiment the top closure is flexible (flex top closure) and forms a liner thereby providing for an improved sealing action.
Figure 14:
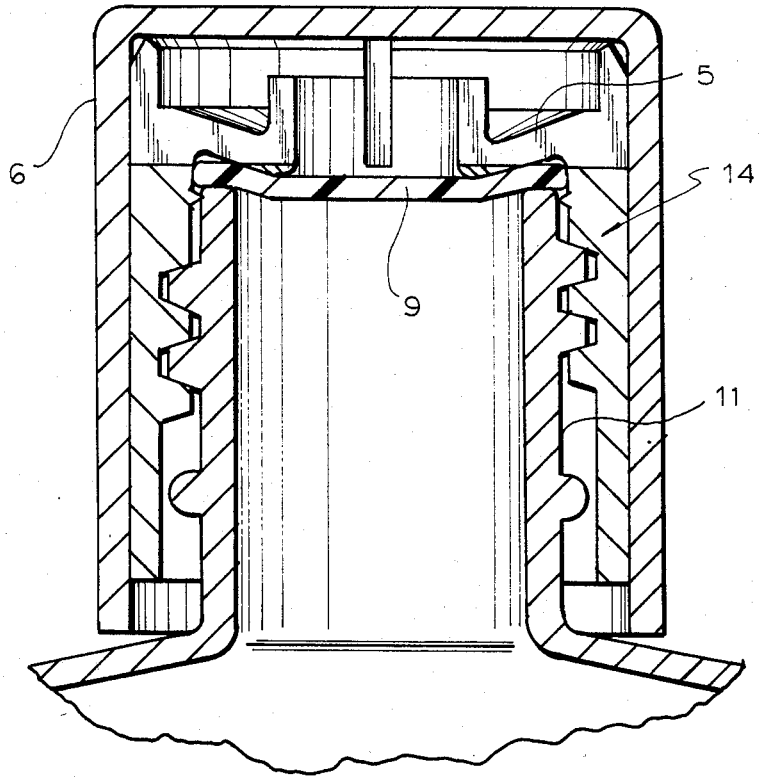
FIG. 14 is a cross-sectional view of a neck portion and closure of the fourth embodiment which shows a disc liner in a closure assembly and which is threadably mounted on a neck portion, which closure resiliently seals the neck portion.

FIGS. 13 and 14 illustrate a further alternate version of the closure assembly of this invention. In this assembly the top closure 14 forms a liner which is disposed inside a decorative cap 6 in which it is coaxially mounted. The top closure 14 has a flexible end face 5 which makes for a good sealing action when this flexible end face 5 presses down and flexes the sealing disc 9.

Figure 16:
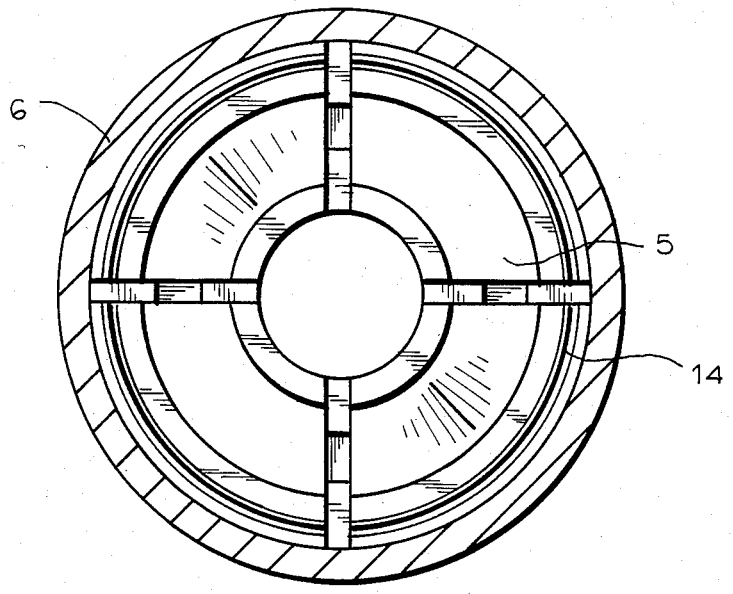
FIG. 16 is a plan view of a liner of a top closure forming a fifth embodiment of the invention, which liner supports a plug brush or dauber.
Figure 17:
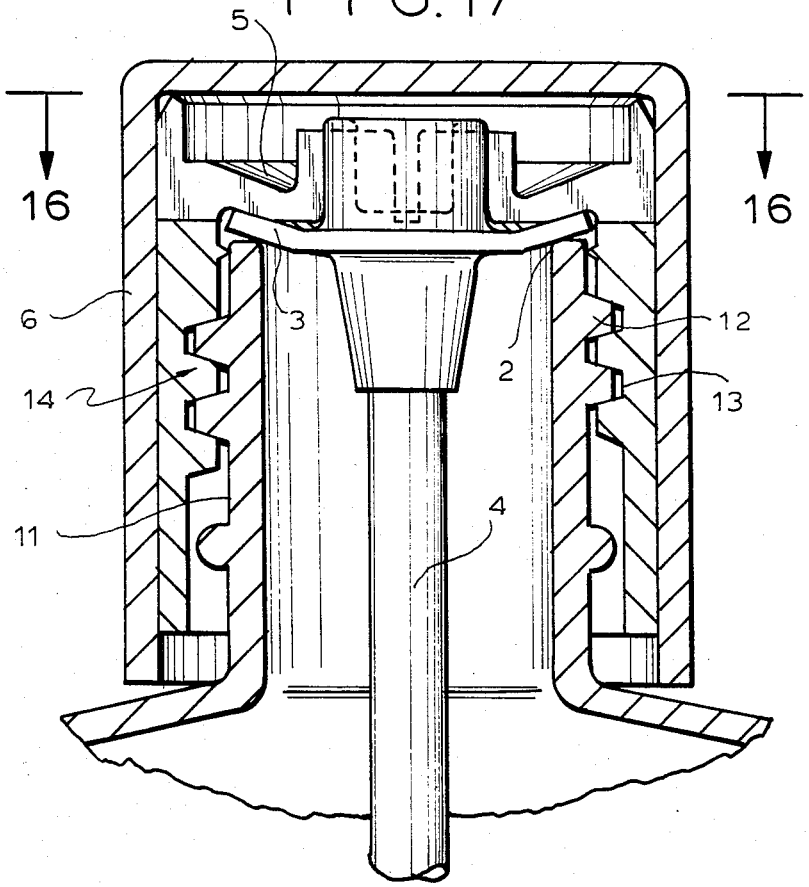
FIG. 17 is a cross-sectional side-elevational view of a neck portion and top closure mounted thereon in which the liner of FIG. 16 is mounted.

In FIGS. 16 and 17 the top closure 14 includes a dauber or brush insert 4 which has a collar portion 3 which forms a sealing disc and which coacts with the internal diameter of the orifice 2 of the neck portion 11. Similar to the embodiment of FIGS. 13 to 15 in the embodiment of FIGS. 16 to 18 the top closure 14 is adapted to form a liner inside of a cap 6.

The shaft 4 of a brush, dauber or wand may be of any known construction.

In the embodiments of FIGS. 12 to 17 the flexible top 5 is such that it withstands sealing pressures to 180° of rotation with a pitch thread of less than 8° after a first seal contact is obtained. Closure stops as shown in FIG. 15 prevent damage to the top or overturning, and sealing bands 17 (FIG. 17) provide extensive rotation latitude with normal torque to another 90° rotation.

As has been described hereinabove, the closure assembly of this invention operates satisfactorily with disc liners 3, 9 and plug inserts 4. The top design and vertical panel of the closure with the thread design of this invention can always be oriented with the vertical panel of the container with a plus/minus 5° of rotation precision.

The system of the invention permits applying the closure open and down on the container in an unoriented relationship therewith as the threads 12, 13 will bring about an automatic orientation of the closure and container.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

What is claimed:

1. A container and closure assembly comprising (a) a threaded neck portion on said container which includes at least one external helical thread having an upper non-helical stop surface and at least one external helical thread having a lower non-helical stop surface;

(b) a closure having at least one internal mating helical thread having an upper non-helical stop surface and at least one internal helical thread having a lower non-helical stop surface;

whereby said upper and lower stop surfaces of said external and internal helical threads respectively contact each other to stop the threading rotation of said closure on said neck portion at a predetermined position.

2. The container and closure assembly as set forth in claim 1, wherein said upper and lower stop surfaces of said external and internal helical threads are respectively 360° rotationally spaced from each other.

3. The container and closure assembly as set forth in claim 1, wherein said closure has a flexible top wall having a downwardly protruding portion.

4. The container and closure assembly as set forth in claim 3, wherein said downwardly protruding portion includes a cylindrical portion and an inwardly tapered downwardly extending frusto-conical portion which is adapted to sealingly engage the top edge of the neck portion of a container.

5. The container and closure assembly as set forth in claim 3, including a flexible sealing disc coaxially mounted in said closure in abutting contact with said downwardly protruding portion, whereby when said closure is threadably rotated a predetermined rotation it presses said sealing disc against the top edge of the threaded neck portion.

6. The container and closure assembly as set forth in claim 3, wherein said flexible top wall has a central bore adapted to receive a shaft for a brush, dauber or wand.

7. The container and closure assembly as set forth in claim 1, wherein said internal and external helical threads are continuous.

8. The container and closure assembly as set forth in claim 1, wherein said internal and external helical threads are interrupted.

9. The container and closure assembly as set forth in claim 1, wherein said lower non-helical stop surface of said one external helical thread forms part of a protrusion on said threaded neck portion.

10. The container and closure assembly as set forth in claim 9, wherein said protrusion is parallel to the longitudinal axis of said neck portion.

* * * * *